US010813506B1

(12) United States Patent
Mitrano et al.

(10) Patent No.: US 10,813,506 B1
(45) Date of Patent: Oct. 27, 2020

(54) SHOWER CHAIR SYSTEM WITH SELECTIVE DELIVERY AND INTERMIXING OF LIQUIDS

(71) Applicants: Cynthia J. Mitrano, Andover, MA (US); Richard P. Mitrano, Andover, MA (US)

(72) Inventors: Cynthia J. Mitrano, Andover, MA (US); Richard P. Mitrano, Andover, MA (US)

( * ) Notice: Subject to any disclaimer, the term of this patent is extended or adjusted under 35 U.S.C. 154(b) by 0 days.

(21) Appl. No.: 16/424,055

(22) Filed: May 28, 2019

Related U.S. Application Data

(60) Provisional application No. 62/679,044, filed on Jun. 1, 2018.

(51) Int. Cl.
*A47K 3/28* (2006.01)
*A61G 5/10* (2006.01)

(52) U.S. Cl.
CPC ..... *A47K 3/282* (2013.01); *A61G 5/1002* (2013.01)

(58) Field of Classification Search
CPC ..... A47K 3/122; A47K 3/282; A61G 5/1002; A61G 7/0005; A61G 7/02; A61G 7/047; A61G 7/1003
USPC ... 4/554–556, 589, 590, 560.1–566.1, 571.1, 4/540, 573.1, 575.1, 578.1
See application file for complete search history.

(56) References Cited

U.S. PATENT DOCUMENTS 3,040,335 A 6/1962 Gellmann
3,169,253 A 2/1965 Segar
4,150,445 A 4/1979 Bailey
4,287,618 A 9/1981 Silver
5,329,651 A 7/1994 Mardero et al.
6,195,814 B1 * 3/2001 Yoshida ..... A47K 3/282 4/601

(Continued)

FOREIGN PATENT DOCUMENTS

CN 207492700 U 6/2018
GB 1582900 A * 1/1981 ..... A47K 3/02

(Continued)

OTHER PUBLICATIONS

Summer Rain Deluxe Shower Chair, RehabMart.com, LLC, website: https://www.rehabmart.com/product/summer-rain-deluxe-shower-chair, May 13, 2019.

*Primary Examiner* — Erin Deery
(74) *Attorney, Agent, or Firm* — Thomas P. O'Connell; O'Connell Law Firm

(57) ABSTRACT

A shower chair with a mobile chair frame, a liquid delivery system with a water intake connection, and a manual control system permitting control of the liquid delivery system. An input control valve is selectively operable to allow water flow through first or second output conduits to a directional valve or through a third output conduit to establish a water temperature test mode. By positioning the input control valve, a mixing mode can be established wherein flowable material is drawn from a vessel and into a Venturi and a rinsing mode can be established where water bypasses the Venturi. By selective positioning of the directional valve, water or water mixed with flowable material can be dispensed from a shower head outlet along a first fluidic route, from anterior and posterior bidet outlets along a second fluidic route, or from both the shower head outlet and the bidet outlets.

21 Claims, 6 Drawing Sheets

(56) References Cited

U.S. PATENT DOCUMENTS

| | | | | |
|---|---|---|---|---|
| 6,817,045 | B1 | 11/2004 | Fainberg | |
| 6,842,919 | B2 | 1/2005 | Wilson et al. | |
| 6,912,740 | B2 * | 7/2005 | Fainberg | A47K 7/026 4/560.1 |
| 8,185,982 | B1 | 5/2012 | Lizama et al. | |
| 8,281,428 | B1 | 10/2012 | Shrewsbury | |
| 9,168,193 | B1 | 10/2015 | Simi | |
| 9,173,528 | B1 | 11/2015 | Shrewsbury | |
| 2010/0275365 | A1 | 11/2010 | Fainberg | |
| 2014/0250587 | A1 | 9/2014 | Alsaffar | |

FOREIGN PATENT DOCUMENTS

| | | | |
|---|---|---|---|
| KR | 100552442 | B1 | 3/2004 |
| KR | 20180081893 | A | 7/2017 |
| KR | 20170088245 | A | 8/2017 |
| WO | WO2018143878 | A1 | 8/2018 |

* cited by examiner

SHOWER CHAIR SYSTEM WITH SELECTIVE DELIVERY AND INTERMIXING OF LIQUIDS

RELATED APPLICATION

This application claims priority to Provisional Application No. 62/679,044, filed Jun. 1, 2018, which is incorporated herein by reference.

FIELD OF INVENTION

The present invention relates generally to bathing support structures. More particularly, disclosed herein is a shower chair with an integrated liquid delivery system with the selective delivery and intermixing of water, soap, and shampoo under manual valve control to facilitate comfortable and effective bathing and showering by persons with limited mobility, injuries, and disabilities.

BACKGROUND OF THE INVENTION

Regular bathing is essential to a person's overall physical and mental well-being. The full health benefits of bathing, whether in the form of showering or a bath in a tub of water, require that all bodily areas be thoroughly soaped and rinsed. It is known that many health issues derive not only from failing to bathe but also from bathing ineffectively. Among the deleterious physical effects of not bathing effectively are skin irritation, bacterial infections of the skin, urinary tract infections, and other serious health issues. Being unable to bathe with independence and safety can also be devastating mentally. Each of these can be minimized by effective bathing on a regular basis.

For the physically mobile and fully able person, the simple tasks of soaping and rinsing can be trivial. However, persons with physical limitations or impairments, such as those with medical injuries, advanced age, or physical disabilities, may find standing and bathing in a conventional shower structure or reclining and washing in a bathtub difficult or impossible. As a result, effective bathing may require assistance, such as from a caregiver.

Caregivers provide a valuable service. However, it may come at the cost of a level of dignity for the person receiving the care and, to an extent, the caregiver. The relative invasiveness required for fully-effective bathing, particularly of the perineal region, can lead to less-than-adequate cleaning in comparison to that required for good health.

It has thus been long-recognized that there is a real need for a shower chair system that permits the selective intermixing and delivery of bathing liquids that is effective in function while remaining efficient and elegant in structure and operation thereby to enable persons with physical limitations or impairments to bathe without assistance or with minimized assistance from a caregiver. Such a personal bathing system is critical to the full realization of the important health benefits and personal maintenance requirements of regular bathing.

By way of example, there is a need to enable persons with restricted mobility that have difficulty standing independently during showering to sit during bathing for added safety and stability. It is further known that persons with physical limitations or impairments seeking to bathe may be limited in their ability to apply and rinse cleaning products, such as soap and shampoo. The difficulty of applying soap and shampoo, and of rinsing the same from one's body, impose further limitations on a person's ability to bathe efficiently and effectively. There is thus a further need to enable a selective dispensing of wetting and rinsing water, cleaning product, and water and cleaning product in mixed form under the control of the person bathing.

Even further, it is recognized that cleaning and rinsing the perineal area of the body can be particularly challenging for persons with mobility impairment. Accordingly, the present inventors further recognized that there is a need for a bathing system with a selectively-controlled bidet function to facilitate washing and rinsing of the perineal area of the body.

Still further, the present inventors have appreciated the need for a personal bathing system with washing and rinsing functionality that can be selectively and conveniently adjusted in operation by ergonomic, manual control. More particularly, the inventors have appreciated that a bathing system permitting hand-operated control over soaping, rinsing, and mixed dispensing of soap and water would permit the person bathing and, as necessary, a caregiver full control over the washing and rinsing functions to promote full, effective bathing.

It is further appreciated that, in view of the inherently wet environment in which such systems are used, it would be advantageous to provide such a bathing system that is completely mechanical in structure and operation. A system capable of operation without dependence on electrical power and without the risks of shock attendant thereto would provide further convenience, effectiveness, and safety to the user and caregiver alike.

A number of skilled inventors have sought to provide solutions to one or more of the well-recognized needs relating to permitting safe and effective bathing by persons with physical limitations. For example, with U.S. Pat. No. 3,040,335, Gellmann disclosed a shower seat capable of being connected to a water supply, such as a shower head or a bathtub spigot, that has a water supply system integrated into a seat frame. While the Gellman shower seat provides for a flow of water over the seat occupant's body, it does not provide for convenient ergonomic control over washing, soaping, and rinsing functions. With U.S. Pat. No. 4,287,618, Silver disclosed a Portable Therapeutic Sitz-Bath, Shower and Bidet Combination with the ability to intermix fluids with incoming water, but the Silver system does not provide for centralized control over fluid flow and intermixing in the manner required for providing optimal independence to the user. U.S. Pat. No. 9,173,528 to Shrewsbury discloses a shower system where control over the flow of water and soap is facilitated, but the system requires pneumatic and plumbing circuitry so that it is exceedingly complex in structure and operation.

Another system known to the prior art is the shower chair sold under the trademark Summer Rain Deluxe Shower Chair by Helping Hands Assistive Tech and Services of Murfreesboro, Tenn. While the Summer Rain chair is disclosed as providing automatic cleaning to the entire body, the chair is understood to rely on electrical remote control and relatively complex electro-mechanical systems for operation. Furthermore, it requires a separate supply of body wash and still demands that the user or a caregiver mix and apply cleaning and other bodily care products. The chair is thus complex in structure and use and is exceedingly expensive. It is thus unattainable to many in real need.

Accordingly, it is apparent that there remains a need for a shower chair system that permits persons with physical limitations and impairments to bathe fully with enhanced independence and safety and that is elegant in structure and operation so that it can be rendered financially accessible to persons in need.

SUMMARY OF THE INVENTION

With an appreciation of the state of the art, the present inventors set forth with the basic object of providing a shower chair that enables full bathing functionality under selective mechanical control thereby to provide persons with physical limitations and impairments with enhanced independence, effectiveness, and safety during bathing.

An underlying object of the invention is to provide a shower chair for persons with physical limitations that promotes full bathing functionality to maintain essential hygiene while maintaining the dignity of users and caregivers throughout the entire bathing process.

A further object of embodiments of the invention is to provide a shower chair for persons with physical limitations that is structurally efficient and convenient in operation to permit a selective delivery and intermixing of liquids to the entire body of the chair occupant.

Another object of embodiments of the invention is to provide a shower chair that enables the selective application, mixing, and rinsing of soap and shampoo from the body of the chair occupant under direct manual control.

An additional object of embodiments of the invention is to provide a shower chair that permits monitoring and adjustment of the temperature of water supplied through the shower chair to a chair occupant to promote comfortable bathing.

In particular embodiments of the invention, an object is to permit selectively-controlled, effective washing and rinsing of the perineal area of the body with enhanced independence of the chair occupant.

Embodiments of the shower chair have the further object of permitting selective control over the flow and mixing of water and cleaning solutions, such as soaps and shampoos, by manual adjustment of mechanical controls without a need for electrical power.

Manifestations of the invention have the further object of providing a shower chair that exploits structural efficiencies to permit its manufacture and sale at accessible cost to promote widespread availability to persons in need.

These and further objects and advantages of embodiments of the invention will become obvious not only to one who reviews the present specification and drawings but also to one who has an opportunity to witness the shower chair disclosed herein in operation. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth the foregoing objects, one embodiment of the present invention comprises a shower chair for enabling bathing by an individual. The shower chair is founded on a mobile chair frame structure with a seat and a back. A liquid delivery system is retained by the chair frame structure. The liquid delivery system comprises a water intake connection, a manual control system comprising an input control valve downstream of the water intake connection and a directional valve downstream of the input control valve. At least one water outlet is disposed downstream of the directional valve. The input control valve is selectively operable to allow the flow of water through a first output conduit to the directional valve or through a second output conduit to the directional valve. A control system housing can be fixed to the chair frame structure, and the manual control system can be retained by the control system housing.

A Venturi tube is fluidically interposed between the first output conduit and the directional valve, and a vessel for retaining flowable material is fluidically connected to the Venturi tube. The Venturi tube can have a low pressure tap, and the vessel is fluidically connected to the low pressure tap of the Venturi tube. Further, a filter is retained within the vessel to be is operative to filter flowable material drawn from the vessel by operation of the Venturi tube. Under such constructions, a first, mixing mode can be established wherein flowable material can be drawn from the vessel and into the Venturi tube by a selective disposition of the input control valve to cause water to flow through the first output conduit, and a second, rinsing mode can be established by a selective disposition of the input control valve to cause water to flow through the second output conduit.

In practices of the invention, there can be at least a first water outlet and a second water outlet downstream of the directional valve. The directional valve can have a first output connection fluidically connected to the first water outlet, and the directional valve can have a second output connection fluidically connected to the second water outlet. By a selective positioning of the directional valve in a first position, fluid can then be passed through the first output connection of the directional valve to the first water outlet along a first fluidic route. By a selective positioning of the directional valve in a second position, fluid can then be passed through the second output connection of the directional valve to the second water outlet along a second fluidic route.

It is further disclosed that the directional valve can have a third position wherein fluid is passed through both the first output connection and the second output connection. With that, fluid can be supplied to the first and second water outlets along the first and second fluidic routes simultaneously.

The first water outlet could be a shower head outlet disposed above the chair frame structure, and the second water outlet could comprise a bidet water outlet disposed in proximity to the seat. In particular embodiments, there can be first and second bidet water outlets disposed along the second fluidic route. For instance, the first bidet water outlet can comprise an anterior bidet shower head, and the second bidet water outlet can comprise a posterior bidet shower head.

To control water pressure incoming to the shower chair, the liquid delivery system can further comprise a pressure regulator valve operative to reduce an incoming water pressure to a reduced water pressure.

In certain embodiments, the input control valve is further selectively operable to allow the flow of water through a third output conduit, and the shower chair incorporates an exit temperature spray nozzle fluidically connected to receive water from the third output conduit. Under such constructions, the input control valve can be adjusted to cause water to flow through the third output conduit to establish a water temperature test mode. Water temperature incoming to the shower chair or flowing through the shower chair can then be adjusted based on the sensed water temperature.

Further, embodiments of the shower chair can have a soap control valve fluidically interposed between the vessel and the Venturi tube for selectively permitting a flow of flowable material from the vessel and into the Venturi tube. For instance, the soap control valve can take the form of a needle valve. The directional valve and the input control valve can, for instance, comprise rotary valves.

According to embodiments of the shower chair, the chair frame structure can be formed with a left side frame structure, a right side frame structure, and a central frame structure that spans from the left side frame structure to the right side frame structure. The seat can have a central opening, and the at least one water outlet can be a bidet water outlet disposed in proximity to the seat. Moreover, a plurality of wheels can be retained to support the frame structure.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTIONS OF THE DRAWINGS

DETAILED DESCRIPTION OF PREFERRED EMBODIMENTS

Figure 1:
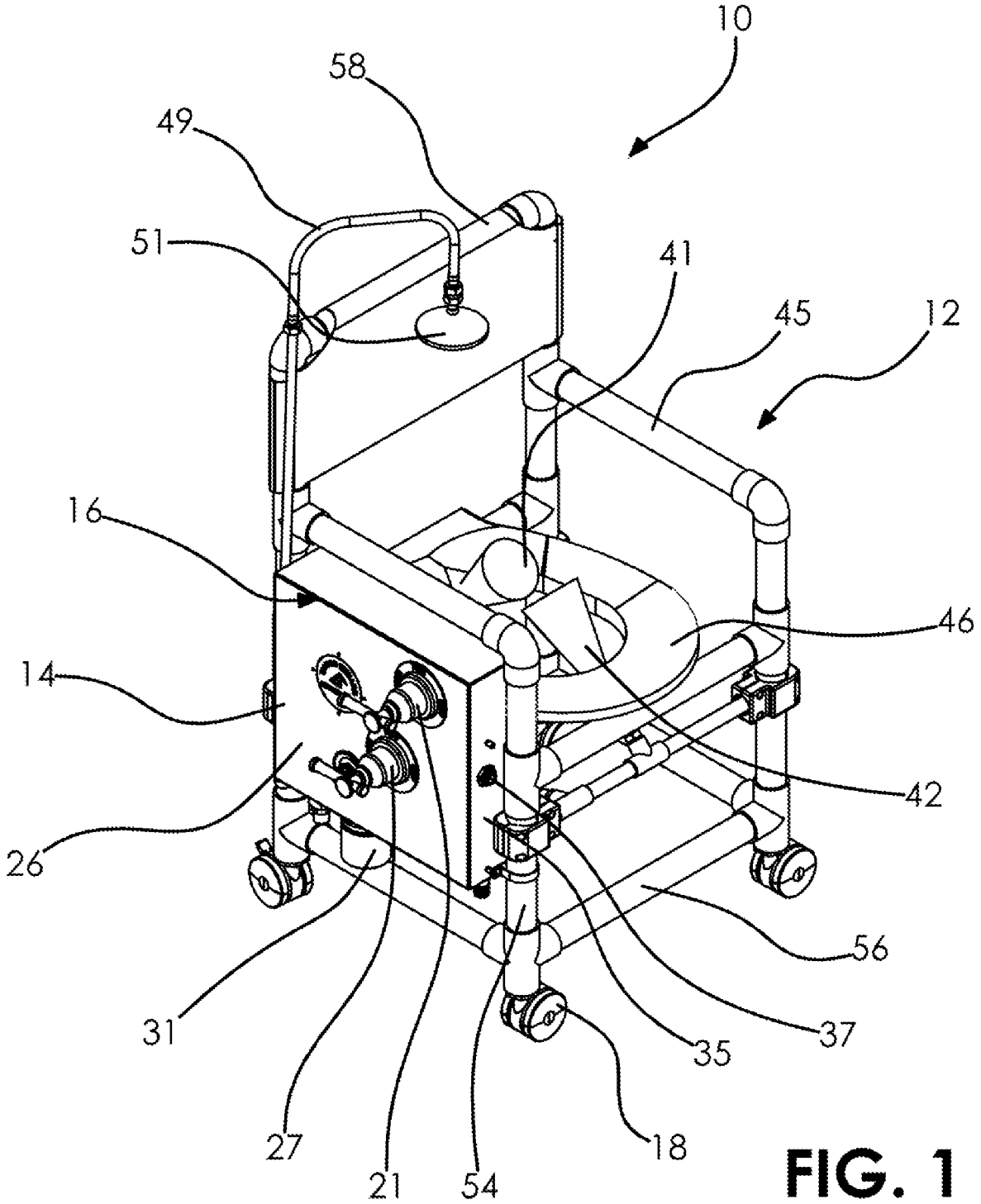
FIG. 1 is a perspective view of a shower chair according to the invention.
Figure 2:
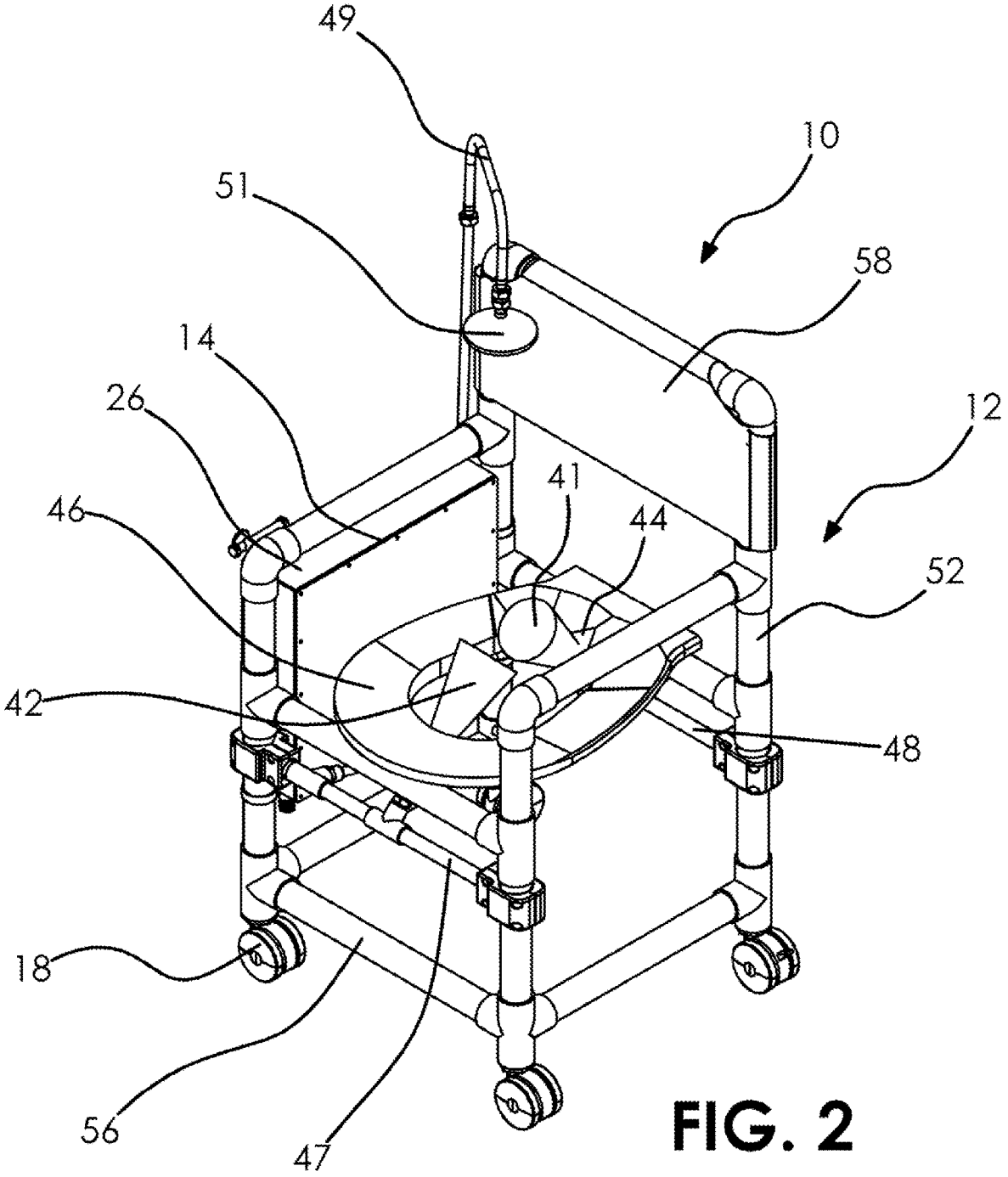
FIG. 2 is an alternative perspective view of the shower chair.
Figure 3:
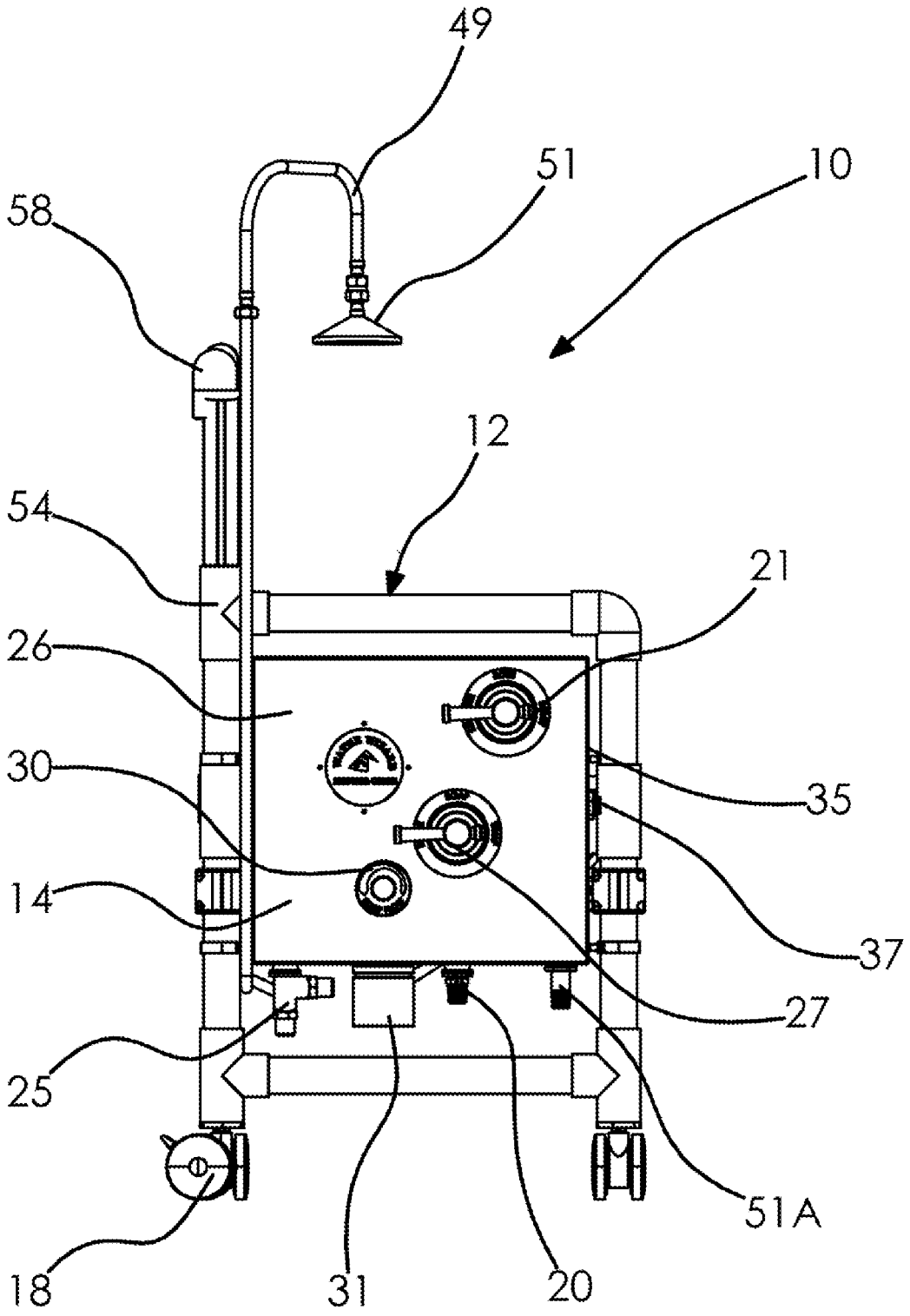
FIG. 3 is a view in side elevation of the shower chair.
Figure 4:
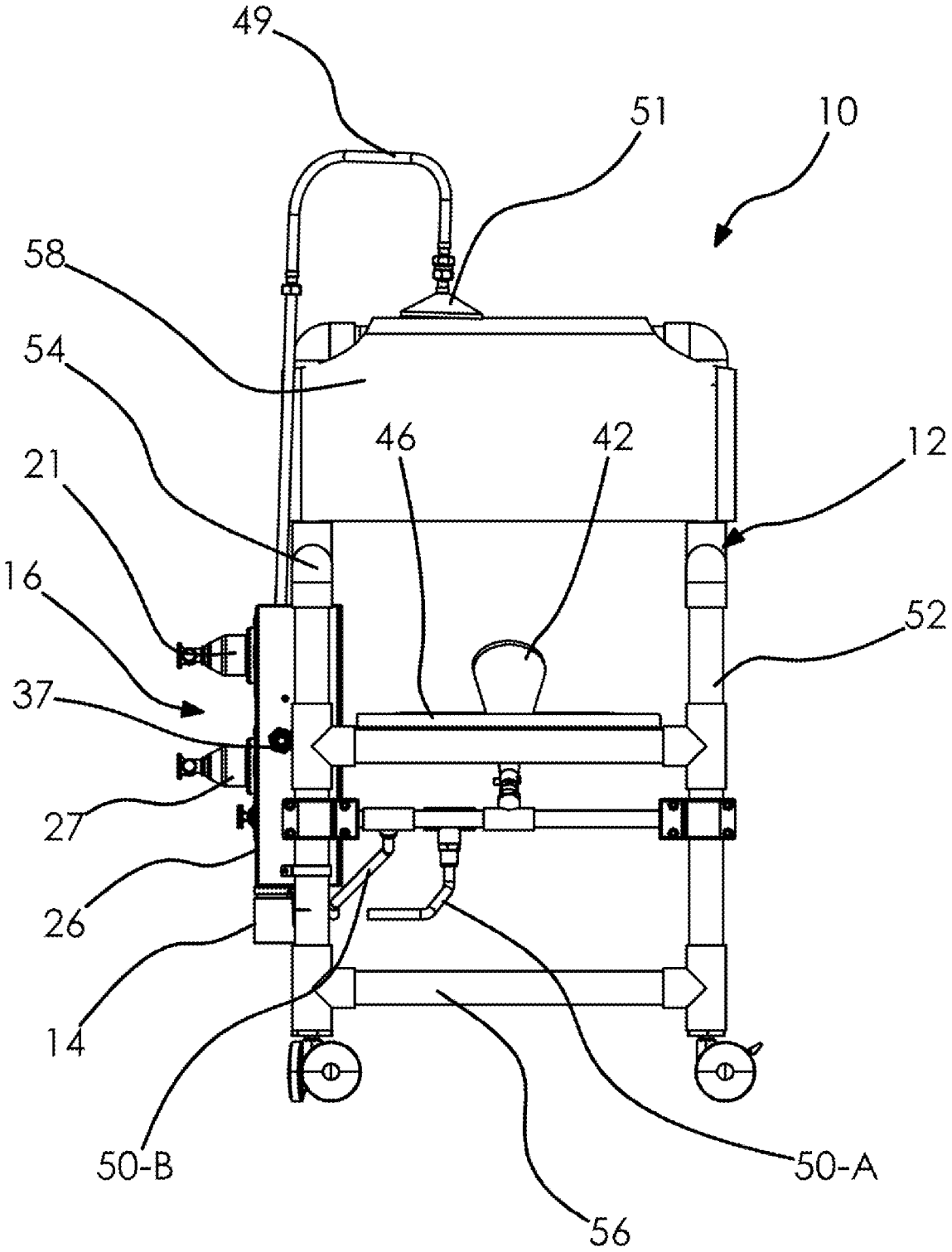
FIG. 4 is a view in front elevation of the shower chair.

The shower chair system with the selective delivery and intermixing of liquids disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Turning more particularly to the drawings, a shower chair according to the invention is indicated generally at 10 in FIGS. 1 through 4 and 6. There, the chair 10 is founded on a freestanding, mobile chair frame 12. A liquid delivery system 14 is integrated into the chair frame 12 for dispensing and intermixing water and cleaning products to a seat occupant to permit full bathing functionality under selective mechanical control. The liquid delivery system 14 is manually controlled through operation of a manual control system 16 that can be actuated and adjusted directly by the chair occupant or, as necessary or desirable, by a dedicated caregiver. By manipulation of the liquid delivery system 14 through operation of the manual control system 16, persons with physical limitations and impairments can achieve full and effective bathing with enhanced independence and safety.

In this non-limiting example of the shower chair 10, the manual control system 16 is retained by the chair frame 12 to overlie the right side frame structure 54, and the components of the liquid delivery system 14 traverse the chair frame 12 to enable the delivery of water and cleaning products to the entire body of the chair occupant.

The chair frame 12 has a left side frame structure 52 and a right side frame structure 54. The left and right frame structures 52 and 54 are joined laterally by a central frame structure 56 that spans from the left side frame structure 52 to the right side frame structure 54. A seat 46 with a central opening 44 is supported atop the central frame structure 56, and a back rest 58 spans from the left to the right side frame structures 52 and 54. In this embodiment, the left and right side frame structures 52 and 54 and the central frame structure 56 are formed with assemblages of tubular conduit and joints, such as corner and T-joints, to form a unified chair frame 12.

It will be understood that the chair frame 12 is not limited to a particular configuration or size except as the same might be expressly required by the claims. By way of an illustrative example, one embodiment of the chair frame 12 could be approximately 26 inches in width, 22 inches in depth, and 38 inches in overall height. The depicted chair frame 12 is disposed in a substantially upright configuration. It will be appreciated that larger or smaller chair frames 12 and chair frames 12 with different and even adjustable configurations may be crafted for particular applications within the scope of the invention.

The chair frame 12 and the shower chair 10 in general can sit directly atop a support surface, such as a shower area, a tub, or some other support surface, where bathing can be accomplished. As is depicted in FIGS. 1 through 4 and 6, for example, the mobility of the shower chair 10 can be improved by the provision of wheels 18 retained by the chair frame 12. In the depicted manifestation of the shower chair 10, four selectively lockable caster wheels 18 are disposed to support the chair frame 12 so that the shower chair 10 can be rolled into and out of position and adjusted in location most conveniently.

Water can be provided to the shower chair 10 by any source of water. By way of example and not limitation, water can be received into a water intake connection 20 from a hose connected to or otherwise supplied by a shower head, a bathtub spigot, or any other source of water. The water intake connection 20 could comprise a single conduit intake, or the water intake connection 20 could provide for separate hot and cold conduit intakes. The water so received can be selectively dispensed at controlled temperature, pressure, and location from any one of a plurality of fluid outlets, including a main shower head outlet 51 and anterior and posterior bidet outlets 41 and 42. As disclosed herein, the outlets 41, 42, and 51 can be caused to dispense liquid, whether in the form of pure rinsing water or water intermixed with a powder, gel, liquid, or other material to form a wash or other solution, through any one or a combination of the outlets 41, 42, and 51 at the direct control of the user by selective actuation of the manual control system 16 to exert control over the liquid delivery system 14.

Figure 5:
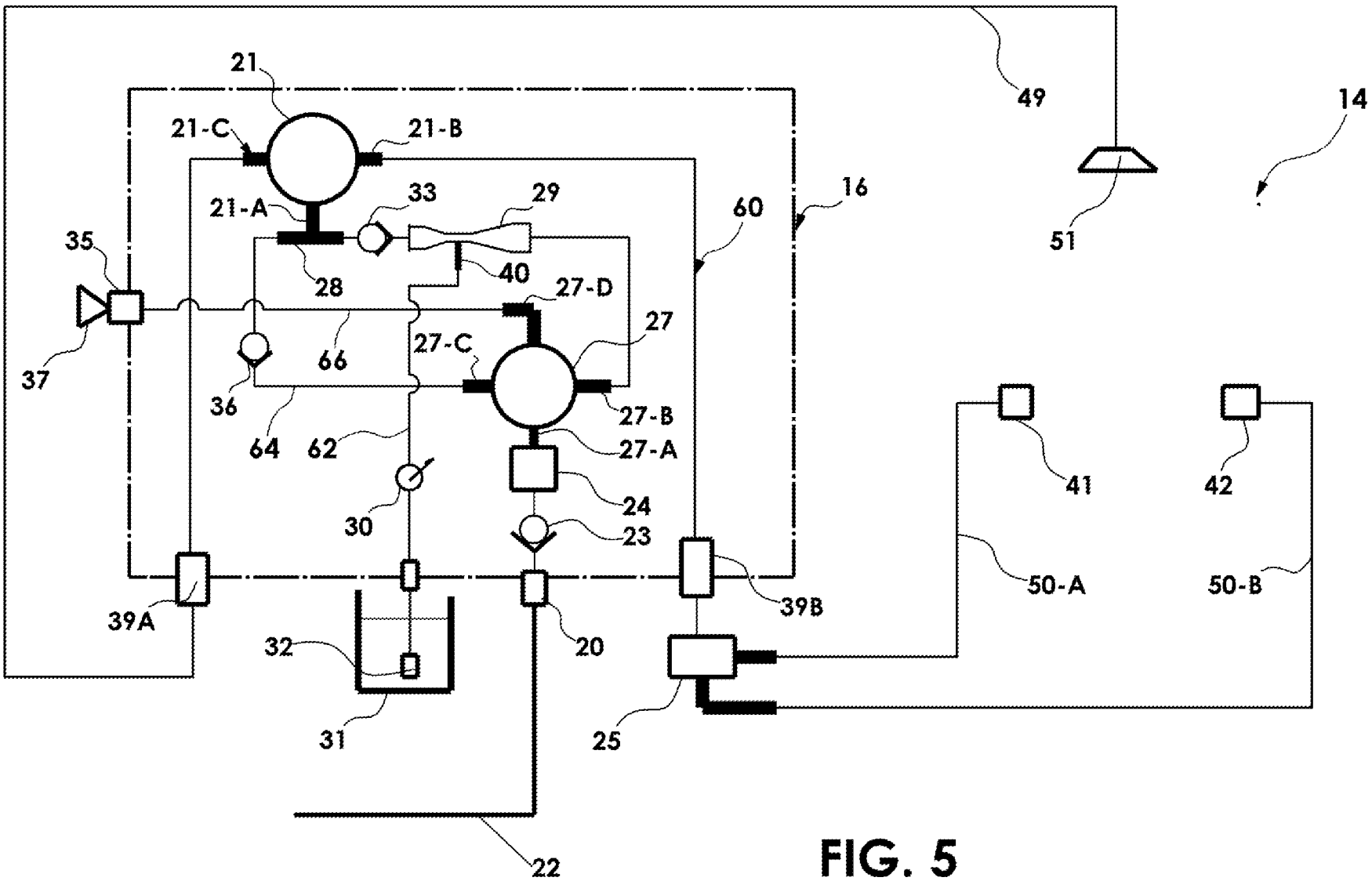
FIG. 5 is a schematic view of a liquid delivery system for the shower chair.
Figure 6:
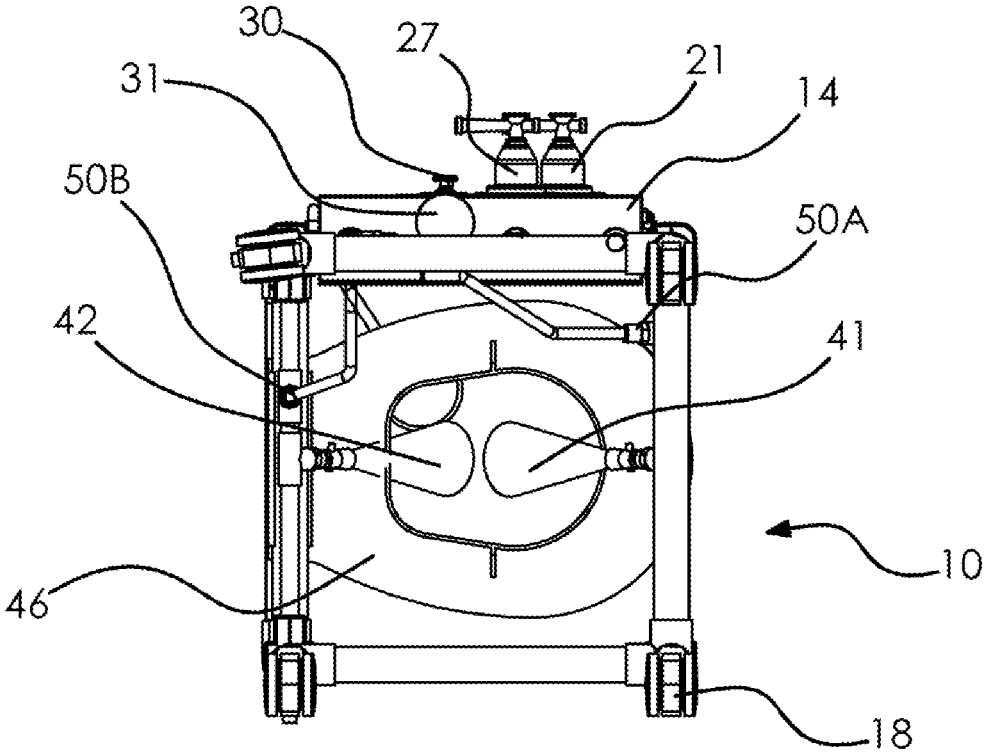
FIG. 6 is a bottom plan view of the shower chair.

The structure and operation of the liquid delivery system 14 and the shower chair 10 in general can be further understood with reference to the schematic depiction of the liquid delivery system 14 in FIG. 5 in combination with the views of the embodiment of the shower chair 10 of FIGS. 1 through 4 and 6. It will be understood that the components and connections of components of the liquid delivery system 14 schematically depicted in FIG. 5 are physically incorporated into the shower chair 10 depicted in FIGS. 1 through 4 and 6.

In this embodiment, flow of the liquid delivery system 14 is controlled through the manual control system 16, which can be considered to be founded on a control system housing 26. The control system housing 26 is retained by the chair frame 12. More particularly, in this manifestation of the shower chair 10, the control system housing 26 is mounted to the right side frame structure 54 of the chair frame 12 with it being understood that the control system housing 26 could be differently disposed. It would also be within the scope of the invention for more than one housing to be provided. Moreover, the plural controls shown and described herein could be retained separately or in different combinations. Still further, additional control features could be incorporated. Moreover, certain components shown and described herein could be integrated into fewer components or potentially separated into further separate components, all within the scope of the invention except as might be expressly limited by the claims.

According to the invention, water provided by one or more sources of water flows through the intake hose or hoses 22 to the water intake connection or connections 20 of the shower chair 10. The water intake connection 20 could include any effective type of fluidic connector, including by way of example and not limitation a threaded hose connection, a snap fitting hose connector, a clamping configuration, or any other fluidic connection. By selective actuation of the liquid delivery system 14, water received into the shower chair system can be dispensed at controlled temperature and pressure through the main shower head outlet 51, the anterior and posterior bidet outlets 41 and 42, or any combination thereof. Water can be dispensed in pure form or selectively intermixed with another material, such as shampoo, soap, or another material, to form a cleansing wash or other solution.

It is recognized by the present inventors that municipal water supplies typically operate at relatively high pressure, oftentimes as high as 90 psi. Meanwhile, it is contemplated that conduits and other components and connections within the present shower chair 10 may advantageously be crafted from lightweight components, such as polyvinyl chloride (PVC) pipes and connectors. Accordingly, during operation of the liquid delivery system 14, water received through the water intake connection 20 is passed to a check valve 23 and then to a pressure regulator valve 24. The pressure regulator valve 24 is operative to reduce downstream water pressure within the shower chair 10 and, equally importantly, as applied to the person bathing in the chair 10. In certain embodiments, for example, the pressure regulator valve 24 can reduce the incoming water pressure from an elevated, municipal pressure to a fixed pressure, such as 55 psi, 40 psi, or some other predetermined value. In other practices of the shower chair 10, the pressure regulator valve 24 is adjustable, such as over a range of adjustment or to plural predetermined values.

From the pressure regulator valve 24, water passes through an input conduit 27A to an input control valve 27. The input control valve 27 is selectively operable, such as by a rotation thereof or some other actuation, to allow the flow of water, such as through a first output conduit 27B, a second output conduit 27C, or a third output conduit 27D.

Water output from the input control valve 27 through the first output conduit 27B is passed through a Venturi tube 29. The exit of the Venturi tube 29 is fluidically connected to an inlet port of a three-way manifold 28 with a soap flow check valve 33 interposed therebetween. A low pressure tap 40 is open to the throat of the Venturi tube 29, and the low pressure tap 40 is fluidically connected to a vessel 31. The vessel 31 can be used to retain a volume of product, such as but not limited to shampoo, soap, body wash, or any other material, to be intermixed with water passed through the Venturi tube 29. A filter 32 is disposed at a distal end of the fluidic conduit 62 between the Venturi tube 29 and the vessel 31 to filter soap, shampoo, or other material retained within the vessel 31. A soap control valve 30, which can be a needle valve 30 according to embodiments of the invention or any other type of effective valve, is interposed along the fluidic conduit 62 between the Venturi tube 29 and the vessel 31 to permit the selective passage of liquid, gel, or other material retained within the vessel 31 from the vessel 31 to the Venturi tube 29 and to the remainder of the liquid delivery system 14 in general as it is intermixed with water.

By actuation of the soap control valve 30 and by selective disposition of the input control valve 27, the shower chair 10 can be disposed in what can be referred to as a soaping mode. For instance, where the control valve 27 comprises a rotary valve, it can be disposed in a given angular orientation to establish the soaping mode. In the soaping mode, water is passed through the first output conduit 27B of the input control valve 27 and through the Venturi tube 29. By operation of the Venturi tube 29, a negative pressure is induced at the low pressure tap 40 thereby tending to draw liquid soap or other flowable material disposed in the vessel 31 through the fluidic conduit 62 and into the flow of water through the Venturi tube 29. Flow of material from the vessel 31 and through the fluidic conduit 62 can be regulated by the soap control valve 30 thereby to permit control of the flow of flowable material from the vessel 31. Where water is passed through the Venturi tube 29 at a flow rate sufficient to create negative pressure and where the soap control valve 30 is adjusted to permit the flow of flowable material from the vessel 31, a mixture of water and soap or other flowable material from the vessel 31 is created, passed through the check valve 33, and supplied to the three-way manifold 28.

The input control valve 27 can be adjusted, such as by a rotation thereof, to what can be referred to as a rinse mode. In the rinse mode, water from the input control valve 27 bypasses the Venturi tube 29 as it is directed through the second output conduit 27C to pass through the check valve 36, into the three-way manifold 28, and then into the directional valve 21 for selective distribution to the main shower head 51, the anterior and posterior bidet shower heads 41 and 42, or both the main shower head 51 and the bidet shower heads 41 and 42 as described further hereinbelow.

A second port of the three-way manifold 28 is fluidically connected to pass liquid to a soap-rinse directional valve 21 through a valve input connection 21A. Liquid output from the control valve 27 through the second output conduit 27C is passed to a third port of the three-way manifold 28 through a fluidic conduit 64 with a rinse water check valve 36 interposed along the fluidic conduit 64. With that, fluid flow received through the valve input connection 21A to the directional valve 21 tends to be restricted by the check valve 36. The check valve 36 is operative to allow one-way flow of fluid therethrough from the input control valve 27, into the three-way manifold 28, and ultimately into the directional valve 21. In a similar manner, check valve 33 is operative to allow one-way flow of fluid therethrough from the input control valve 27, into the three-way manifold 28, and ultimately into the directional valve 21.

Water flowing from the control valve 27 through the third output conduit 27D is passed to an exit temperature test spray nozzle 37 that in this embodiment is disposed within the control system housing 26 to eject water laterally from the chair frame structure 12 and the shower chair 10 in general through a fluidic conduit 66. An exit temperature test bulkhead 35 is interposed along the fluidic conduit 66. The control valve 27 can thus be adjusted, such as by a rotation thereof or otherwise, to what can be referred to as a water temperature test mode wherein a flow of water is directed through the valve 27 to the third output conduit 27D and through the fluidic connection path 66 to the exit temperature test bulkhead 35 and then to the exit temperature test spray nozzle 37. The operator, whether that be the seat occupant or a caregiver, can then adjust the temperature of incoming water to the shower chair 10, or potentially within the shower chair 10 where hot and cold water supplies are provided, to a desired temperature condition based on the sensed water exit temperature.

The soap-rinse directional valve 21 has first and second output connections 21B and 21C. The first output connection 21B is fluidically connected to the anterior and posterior bidet outlet heads 41 and 42. More particularly, in this embodiment, a fluidic conduit 60 passes liquid from the directional valve 21 to a bidet manifold 25. A bulkhead connector 39B is interposed along the fluidic path from the output connection 21B of the valve 21 to the bidet manifold 25 as the fluidic conduit 60 exits the control system housing 26. From the bidet manifold 25, first and second bidet feed conduits 50A and 50B fluidically connect the bidet manifold 25 to the first and second bidet outlet heads 41 and 42 respectively. Under control of the valves 21 and 27, therefore, the bidet shower heads 41 and 42 can be selectively supplied with water or a mixture of water and material, such as soap, shampoo, body wash, or some other material or combination thereof, drawn from the vessel 31 through the first and second bidet feed conduits 50A and 50B.

The second output connection 21C from the directional valve 21 is fluidically connected to the shower head 51 by a fluidic conduit 49, and a bulkhead connector 39A is interposed along the fluidic conduit 49 from the soap-rinse directional valve 21 to the shower head 51 as the fluidic conduit 49 exits the control system housing 26. The shower head 51 could, by way of example and not limitation, be a wand shower head retained by a flexible hose comprising the fluidic conduit 49. Alternatively, the shower head 51 could be retained in a substantially fixed location, potentially with a pivoting connection, such as with rigid piping comprising the fluidic conduit 49. Selective manipulation of the valves 21 and 27 can thus permit the controlled supply of water or a solution of water and material drawn from the vessel 31 to the shower head 51 through the fluidic conduit 49 that is connected to the output shower bulkhead connector 39A from the control system housing 26.

As disclosed herein, the fluidic conduits, such as those indicated at 49, 60, 62, 64, and 66, can comprise hose connections, piping or tubing, or any other type of fluidic connector or combination thereof. By way of example and not limitation, generally rigid fluidic connectors, such as pipes or rigid tubular conduits, can be employed over portions of fluidic connection paths where flexibility is not required while hose connectors can be provided where flexibility is desirable, such as in the terminal connection portions to the shower head 51 or the bidet outlet heads 41 and 42. Where adjustable positioning of the shower head 51 or the bidet outlet heads 41 and 42 is desired, the terminal connection portions can comprise memory flex hose connections or other repositionable conduit sections. Except as expressly required by the claims, each fluidic conduit shown and described herein could be formed as a single length of conduit material or with multiple sections of the same or different types of conduit material of any type effective to establish a fluidic connection. The actual shower outlet heads 41, 42, and 51 likewise could pursue numerous embodiments within the scope of the invention, including spray heads, adjustable heads, nozzle heads, or any other type of water-emitting head.

In practices of the invention, the soap-rinse directional valve 21 and the input control valve 27 can be rotary valves, although the invention is not so limited except as may be expressly required by the claims. By selective positioning of the directional valve 21 in a first position, fluid can then be passed through the first output connection 21B of the valve 21, through the fluidic connection path 60, through the bulkhead connector 39B to the first and second bidet feed conduits 50A and 50B, and ultimately to the anterior and posterior bidet shower heads 41 and 42. The directional valve 21 can be alternatively positioned in a second position to cause fluid to be passed through the second output connection 21C of the valve 21, through the fluid connection path 49 including through the bulkhead connector 39A, and ultimately to the shower head 51. The directional valve 21 can have a third position where fluid is passed through both the first output connection 21B and the second output connection 21C thereby to supply fluid to the main shower head 51 and the bidet shower heads 41 and 42 simultaneously.

The shower chair 10 can thus be considered to have a first dispensing condition with a first fluidic route comprising a bidet dispensing route operative to dispense liquid from either or both of the anterior and posterior bidet outlets 41 and 42. The shower chair 10 has a second dispensing condition with a second fluidic route comprising a shower head dispensing route operative to dispense liquid from the shower head 51, and the shower chair 10 has a third dispensing condition wherein liquid passes through both the first and second fluidic routes to dispense liquid from the shower head 51 and the bidet outlets 41 and 42. Further, within the scope of the invention, it would be possible to have a bidet control valve, which could be incorporated into the bidet manifold 25 or separately disposed, for selectively controlling fluid flow to the anterior bidet shower head 41, the posterior bidet shower head 42, or to both bidet shower heads 41 and 42.

Under the construction disclosed herein, the shower chair 10 provides persons with physical limitations and impairments enhanced independence, effectiveness, and safety during bathing. Under selective manual control, an individual bathing or a caregiver can adjust between soaping and rinsing modes and can control and adjust flow through plural shower heads 41, 42, and 51. Full bathing can be enjoyed to enable essential hygiene while maintaining the dignity of users and caregivers throughout the entire bathing process. Users of the shower chair 10 can experience selectively-controlled, effective washing and rinsing of the perineal area of the body with enhanced independence. Moreover, by use of the exit temperature test spray nozzle 37, a person can monitor and adjust the temperature of water supplied through the shower chair 10 to a chair occupant to promote safe and comfortable bathing. The shower chair 10 is operative to achieve the foregoing without a need for electrical power and with structural efficiencies that permit its manufacture and sale at an accessible cost that then can facilitate widespread availability to persons in need. The shower chair 10 thus represents a solution to plural longfelt needs in the field of bathing systems and methods for persons with physical limitations.

With certain details and embodiments of the present invention for a shower chair 10 with the selective delivery and intermixing of liquids disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall be considered to define the scope of protection to be afforded to the inventors. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally cognizable equivalents thereof.

We claim as deserving the protection of Letters Patent:

1. A shower chair for enabling bathing by an individual, the shower chair comprising:

a mobile chair frame structure with a seat and a back;

a liquid delivery system retained by the chair frame structure wherein the liquid delivery system comprises a water intake connection, a manual control system comprising an input control valve downstream of the water intake connection and a directional valve downstream of the input control valve, and at least one water outlet downstream of the directional valve, wherein the input control valve is selectively operable to allow the flow of water received through the water intake connection through a first output conduit to the directional valve or through a second output conduit to the directional valve;

a Venturi tube fluidically interposed between the first output conduit and the directional valve;

a vessel for retaining flowable material wherein the vessel is fluidically connected to the Venturi tube;

whereby a first, mixing mode can be established wherein flowable material can be drawn from the vessel and into the Venturi tube by a selective disposition of the input control valve to cause water to flow through the first output conduit and whereby a second, rinsing mode can be established by a selective disposition of the input control valve to cause water to flow through the second output conduit.

2. The shower chair of claim 1 wherein the at least one water outlet comprises at least a first water outlet and a second water outlet downstream of the directional valve, wherein the directional valve has a first output connection fluidically connected to the first water outlet, and wherein the directional valve has a second output connection fluidically connected to the second water outlet wherein, by a selective positioning of the directional valve in a first position, fluid can then be passed through the first output connection of the directional valve to the first water outlet along a first fluidic route and wherein, by a selective positioning of the directional valve in a second position, fluid can then be passed through the second output connection of the directional valve to the second water outlet along a second fluidic route.

3. The shower chair of claim 2 wherein the directional valve has a third position wherein fluid is passed through both the first output connection and the second output connection thereby to supply fluid to the first and second water outlets along the first and second fluidic routes simultaneously.

4. The shower chair of claim 2 wherein the first water outlet comprises a shower head outlet and wherein the second water outlet comprises at least one bidet water outlet disposed in proximity to the seat.

5. The shower chair of claim 4 wherein the at least one bidet water outlet comprises at least first and second bidet water outlets disposed along the second fluidic route.

6. The shower chair of claim 5 wherein the first bidet water outlet comprises an anterior bidet shower head and wherein the second bidet water outlet comprises a posterior bidet shower head.

7. The shower chair of claim 1 further comprising a control system housing fixed to the chair frame structure wherein the manual control system is retained by the control system housing.

8. The shower chair of claim 1 wherein the at least one water outlet comprises a main shower head outlet and at least one bidet water outlet retained in proximity to the seat.

9. The shower chair of claim 8 wherein the at least one bidet water outlet comprises anterior and posterior bidet water outlets retained in proximity to the seat.

10. The shower chair of claim 1 wherein the liquid delivery system further comprises a pressure regulator valve operative to reduce an incoming water pressure through the water intake connection to a reduced water pressure.

11. The shower chair of claim 1 wherein the input control valve is further selectively operable to allow the flow of water through a third output conduit and further comprising an exit temperature spray nozzle fluidically connected to receive water from the third output conduit whereby the input control valve can be adjusted to cause water to flow through the third output conduit to the exit temperature spray nozzle to establish a water temperature test mode.

12. The shower chair of claim 1 further comprising a control valve fluidically interposed between the vessel and the Venturi tube for selectively permitting a flow of flowable material from the vessel and into the Venturi tube.

13. The shower chair of claim 12 wherein the control valve comprises a needle valve.

14. The shower chair of claim 1 wherein the directional valve and the input control valve comprise rotary valves.

15. The shower chair of claim 1 wherein the chair frame structure comprises a left side frame structure, a right side frame structure, and a central frame structure that spans from the left side frame structure to the right side frame structure.

16. The shower chair of claim 1 wherein the seat has a central opening and wherein the at least one water outlet comprises a bidet water outlet disposed in proximity to the seat.

17. The shower chair of claim 1 further comprising a plurality of wheels retained to support the frame structure.

18. The shower chair of claim 1 wherein the Venturi tube has a low pressure tap wherein the vessel is fluidically connected to the low pressure tap of the Venturi tube.

19. The shower chair of claim 18 further comprising a filter retained within the vessel wherein the filter is operative to filter flowable material drawn from the vessel by operation of the Venturi tube.

20. A shower chair for enabling bathing by an individual, the shower chair comprising:

a mobile chair frame structure with a seat and a back;

a liquid delivery system retained by the chair frame structure wherein the liquid delivery system comprises a water intake connection, a manual control system comprising a directional valve downstream of the water intake connection, and at least a first water outlet and a second water outlet downstream of the directional valve, wherein the directional valve has a first output connection fluidically connected to the first water outlet, and wherein the directional valve has a second output connection fluidically connected to the second water outlet wherein, by a selective positioning of the directional valve in a first position, fluid can then be passed through the first output connection of the directional valve to the first water outlet along a first fluidic route and wherein, by a selective positioning of the directional valve in a second position, fluid can then be passed through the second output connection of the directional valve to the second water outlet along a second fluidic route; and an input control valve fluidically disposed between the water intake connection and the directional valve wherein the input control valve is selectively operable to allow the flow of water received through the water intake connection through a first output conduit to the directional valve or through a second output conduit to the directional valve; a Venturi tube fluidically interposed between the first output conduit and the directional valve; a vessel for retaining flowable material wherein the vessel is fluidically connected to the Venturi tube; whereby a first, mixing mode can be established wherein flowable material can be drawn from the vessel and into the Venturi tube by a selective disposition of the input control valve to cause water to flow through the first output conduit and a second, rinsing mode can be established by a selective disposition of the input control valve to cause water to flow through the second output conduit.

21. The shower chair of claim 20 wherein the directional valve has a third position wherein fluid is passed through both the first output connection and the second output connection thereby to supply fluid to the first and second water outlets along the first and second fluidic routes simultaneously.

* * * * *